United States Patent [19]

Schiel et al.

[11] 4,000,035

[45] Dec. 28, 1976

[54] MACHINE FOR DRYING WEBS, INCLUDING SUCTION AND HEAT-CONTACT CYLINDERS

[75] Inventors: Christian Schiel, Heidenheim; Gerhard Kotitschke, Steinheim; Heinz Beck; Wilfried Kraft, both of Heidenheim (Brenz); Theo Hägele, Oberkochen, all of Germany

[73] Assignee: J. M. Voith GmbH, Heidenheim, Germany

[22] Filed: May 9, 1974

[21] Appl. No.: 468,444

[30] Foreign Application Priority Data

May 10, 1973 Germany ..... 2323574

[52] U.S. Cl. ..... 162/290; 34/115; 34/116; 34/117; 34/158; 34/159; 162/306

[51] Int. Cl.[2] ..... D21F 5/04

[58] Field of Search ..... 162/290, 306, 359, 368, 162/372, 207; 34/18, 23, 111, 115, 116, 117, 123, 158, 159, 161, 162, 203

[56] References Cited

UNITED STATES PATENTS

| | | | |
|---|---|---|---|
| 2,091,805 | 8/1937 | Chuse | 162/290 X |
| 3,237,316 | 3/1966 | Sachs | 34/115 |
| 3,503,139 | 3/1970 | Mahoney | 34/111 |
| 3,753,298 | 8/1973 | Ely | 34/116 |
| 3,816,941 | 6/1974 | Holik et al. | 162/207 X |
| 3,874,997 | 4/1975 | Kan Kaanpää | 162/290 |

FOREIGN PATENTS OR APPLICATIONS

| | | | |
|---|---|---|---|
| 968,619 | 9/1964 | United Kingdom | 34/117 |

*Primary Examiner*—Robert L. Lindsay, Jr.
*Assistant Examiner*—Richard V. Fisher
*Attorney, Agent, or Firm*—Michael J. Striker

[57] ABSTRACT

A paper-making machine has a plurality of drying cylinders for removing moisture from a wet web. The drying cylinders are arranged so that some of them are located in an upper plane and are hollow and have their interior connected to a source of suction, and others are located in a lower plane and are heated to form contact heaters. An endless traveling carrier band is trained about these cylinders in such a manner that its one surface which carries the wet web faces away from the hollow cylinders as it travels about them and faces towards the heated cylinders as it travels about the latter.

6 Claims, 2 Drawing Figures

MACHINE FOR DRYING WEBS, INCLUDING SUCTION AND HEAT-CONTACT CYLINDERS

BACKGROUND OF THE INVENTION

The present invention relates generally to the drying of wettable webs, and more particularly to a machine for carrying out such drying.

The invention is concerned in particular with drying of wet paper webs in a paper-making machine, and will hereafter be described with reference to such an application. It should be understood, however, that the invention can also be successfully employed in drying of other webs from which moisture must be removed.

It is known that in paper-making machines the newly produced paper web is wet and must be dried, both to improve its strength and to prepare it for subsequent additional processing steps. For this purpose, drying arrangements are known whose purpose it is to withdraw moisture from the web. Thus, German Patent No. 1,911,653 (corresponding to U.S. application Ser. No. 712,260 now U.S. Pat. No. 3,503,139) discloses an arrangement on which the web to be dried is supported on an endless traveling band of felt which carries it through the drying arrangement. The drying rollers comprise a series of upper rollers which are hollow and have permeable walls, and whose exterior is connected to a source of suction in order to withdraw moisture from the web by drawing away from the interior of the rollers. Located in a lower second plane are rollers which are heated in order to expel residual moisture from the web. In this prior-art construction the side of the felt web on which the wet paper web is supported faces away from the upper suction rollers as it travels around the same, so that it is the other side—the one which does not support the wet paper web—which is in direct contact with the circumferential walls of the suction rollers. Conversely, when the felt band and the wet web travel around the heated lower rollers, the side of the felt band on which the wet paper web is supported faces towards the heated rollers so that the wet paper web is in direct contact with the surfaces of the heated rollers against which it is pressed by the felt band. It is desired that during its travel around both types of rollers the paper web is subjected as much as possible to identical temperatures, and the rollers which form contact heaters and are engaged by the paper web directly are to be heated to a lesser extent than the upper suction rollers in order to avoid damage to the paper web.

It has been found that this arrangement is not fully satisfactory. In particular, optimum drying conditions cannot be obtained with this prior-art arrangement, for various reasons of which one is the fact that the wet paper web is not in direct contact with the heated suction rollers located at the upper level or in the upper plane, so that the heat from these rollers must first penetrate through the felt carrier band before it can act upon the paper web. Again, when the felt band and the wet web travel around the heated lower rollers in contact therewith, the moisture which is expelled from the web is received in the felt band and, when the band and the web subsequently move into contact with the next one of the rollers at the upper level, this moisture is reabsorbed into the paper web from the felt band. On the other hand, it is not possible to eliminate the felt band entirely because the paper web is not yet sufficiently strong to be self-supporting, especially at the relatively high speeds at which it is required to travel to and past the different rollers.

SUMMARY OF THE INVENTION

Accordingly, it is an object of the present invention to provide an improved machine which takes into consideration the above-outlined disadvantages of the prior art, and overcomes them.

More particularly, it is an object of the present invention to provide such an improved machine in which optimum drying of the wet web is obtained even at high operating speeds.

In keeping with these objects, and with others which will become apparent hereafter, one feature of the invention resides, in a machine for processing wettable webs, particularly in a paper-making machine, wherein a plurality of drying cylinders is provided for removing moisture from a wet web, and an endless traveling carrier band is trained about these cylinders and has a surface on which the web is supported, in the improvement wherein at least a first one of these cylinders is hollow and perforate and has its interior connected to a source of suction, the first cylinder being located in a first plane and the carrier band being trained about it with the aforementioned surface facing away from the first cylinder. At least a second one of the cylinders is a contact heater located in a vertically spaced second plane, and the carrier band is trained about the second cylinder with its surface facing towards the second cylinder. With this arrangement, moisture is drawn by suction from the web and through the carrier band during travel around the first cylinder, and is expelled by heating from the web and outwardly away from the carrier band during travel around the second cylinder. The arrangement according to the present invention thus assures that the flow of heat and moisture is always from the paper web to the carrier band, rather than alternating as in the prior art, whereby a reabsorption of moisture into the paper web from the carrier band is avoided. The water or moisture which enters into the carrier band is removed from the same in known manner by means of devices known in the art; for instance if the carrier band is a felt band, then felt conditioning devices known in the paper-making art are applied to remove the moisture. This is done either intermediate the upper and lower planes in which the respective rollers or cylinders are located, or in that portion of the endless path of the carrier band in which it returns from the downstream end of the drying passage back to the upstream end thereof.

In addition, the arrangement according to the present invention has a further advantage, in that each cylinder that operates as a suction cylinder causes a cooling of the paper web, so that when the paper web subsequently comes in contact with the next-following contact heater there will be a substantial temperature difference between the surface of that contact heater and the paper web.

The heat required at the suction cylinders is advantageously supplied by means of hot-air hoods located adjacent the suction cylinders and serving to blow hot and dry air against the paper web as it travels around these suction cylinders. Air temperatures between approximately 150° and 300° C are customary in the industry, and can be used in the arrangement according to the present invention. However, because of the cooling effect of the suction rollers, and depending, of course, upon the humidity of the ambient air, the paper web itself will have a temperature of only approximately 70° C. The hoods, which may have electric heaters and blowers of conventional construction associated with them, could also be replaced by infrared radiators or the like which are similarly known from the art.

When the web has travelled around one of the suction cylinders and then comes in contact with the next-following heating cylinder that is constructed as a dry-contact heater, it is subjected to a much higher temperature than before. The temperature difference which can be obtained between the web and the contact heater as a result of the cooling effect of the suction cylinders, causes excellent drying effectiveness at the contact heater, since the drying effect is proportional to the temperature difference between the paper web and the contact heater which exists at the time of contact between them.

If hot-air hoods are used, the effective width of these hoods is advantageously smaller than the width of the paper web, so that the hot air is directed only at the paper web and does not immediately come in contact with the material of the carrier band. Depending upon the particular material of the carrier band, for instance felt, it is frequently not possible to use optimum heat conditions in such arrangements, but the proposal according to the present invention eliminates this drawback and makes it possible to employ temperatures which might otherwise be too high for the material of the carrier band and might damage the same.

Of course, the wet paper web must be started on its travel through the drying arrangement, either when a new web begins or when a web has broken and must be started up again. This presents usually substantial difficulties if the paper web is supported only and exclusively on the carrier band. For this reason it is conventional to use a cover or guide band which overlies the carrier band and between which the paper web is sandwiched during its travel through the heating arrangement. It is evident that this guide band significantly reduces the efficiency with which the paper web can be dried, because it cuts down on the access of hot air to the paper web. It is known in some applications other than the types with which the present invention is concerned, to use a rope guide having guide ropes between which marginal portions of a web are engaged and guided. However, such an arrangement is not useable in the context of the present invention, because webs of the type here under discussion must be supported on a carrier band which extends outwardly beyond the lateral edges of the web by approximately 15 cm on each side, in order to assure proper guidance of the web. This means that the guide ropes, which must be located laterally outwardly away from the carrier band for safety reasons, would have to pull the leading end of the wet web laterally to such an extent that the as yet wet and readily torn web would almost certainly tear, at least at high operating speeds.

The present invention overcomes this problem also, in that according to a further concept of the invention a relatively narrow guide band may be utilized which can clamp the leading end of the paper web between itself and the carrier band, and which can be shifted laterally beyond one lateral edge of the paper web once the latter has been inserted into the arrangement and requires no further guidance from the guide band.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
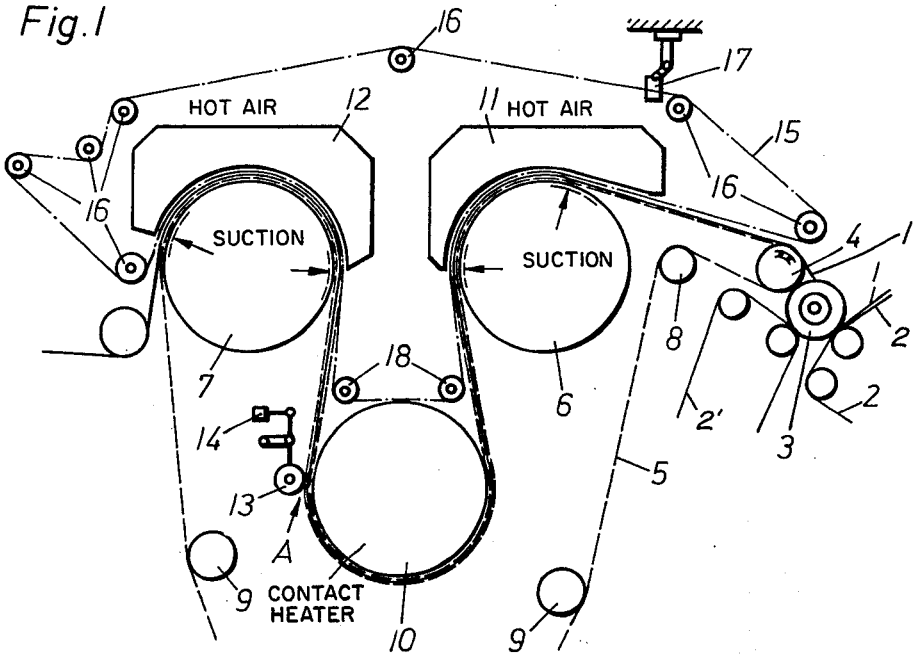
FIG. 1 is a fragmentary diagrammatic side elevation showing a portion of an arrangement according to the present invention, on hand of which the invention will be explained.

Referring now to the drawing in detail, it will be seen that reference numerals 2 and 2' identify portions of an arrangement, such as a press, located upstream of the arrangement according to the present invention, such portions being sufficient for an understanding of the invention.

Reference numeral 1 identifies a wet paper web which has just been produced in known manner and which must now be dried. The paper web 1 is supplied resting on a felt band 2 from which it is transferred to a transfer roller 3 against which it is pressed by a further band 2'. From the transfer roller 3, the web 1 travels onto a suction roller 4 which is located within a loop formed by a carrier band 5 that is an endless band and travels through the drying arrangement. The web 1 is shown as adhering to the transfer roller 3 beyond the point of contact of the latter with the carrier band 5 trained about the suction roller 4. The carrier band 5 may be a conventional felt band, but instead a screen or wire band can also be employed.

The arrangement further comprises a number of drying cylinders, and FIG. 1 illustrates two of these, namely the cylinders 6 and 7, located in an upper plane, and a further drying cylinder 10 located in a lower plane. Guide rollers 8 and 9 guide the carrier band 5.

As the legends indicate in FIG. 1, the interior of the cylinders 6 and 7 is connected with a non-illustrated source of suction, whereas the cylinder 10 acts as a contact cylinder which is heated in appropriate manner, for instance by having resistance wires embedded in it. Such constructions are known in the art. It should be noted that as the wet paper web 1 travels on the carrier band 5, it will come into direct contact with the heated circumferential surface of the drying cylinder 10 since the carrier band 5 is located on the outer side of the paper web 1.

In the region of the suction cylinders 6 and 7 there is provided a pair of hot-air hoods 11, 12 which blow hot air upon the web 1. The arrows associated with the rollers 6 and 7 indicate where the carrier band 5 and the web 1 first contact and subsequently leave the respective rollers or cylinders 6, 7.

At a location A where the carrier band 5 and the web 1 leave the circumference of the respective cylinder 10, there is located within the loop formed by the carrier band 5 a suction roller 13 whose interior is of course connected with a source of suction (not illustrated because conventional) and which draws the paper web 1 against the carrier band 5 by suction, to prevent the paper web 1 from traveling along with the cylinder 10 and from being lifted off the carrier band 5. The roller 13 is mounted pivotably, as illustrated, and can yield so as to be able to move toward and away from the cylinder 10 in the event that the paper web 1 should be formed with thicker portions or knots or the like. A cylinder and piston unit 14 which is fluid-operated is provided which can tilt the suction roller 13 closer towards or further away from the roller 10, to adjust the arrangement for paper webs 1 of different thicknesses.

A relatively narrow (in direction normal to the plane of FIG. 1) guide band 15 is provided which serves to insert the leading end of the paper web 1 into the drying arrangement. For this purpose the leading end of the web 1 is clampingly engaged between the carrier band 5 and the guide band 15 which latter travels around all three of the cylinders 6, 7 and 10 and is guided by several rollers 16. A bifurcated adjusting arrangement 17 is provided which serves to shift the guide band 15 laterally of the paper web 1, that is normal to the plane of FIG. 1. However, this could be replaced with an inclined roller 16, that is a roller which could have its axis of rotation so inclined as to guide the band 15 in the desired manner.

Figure 2:
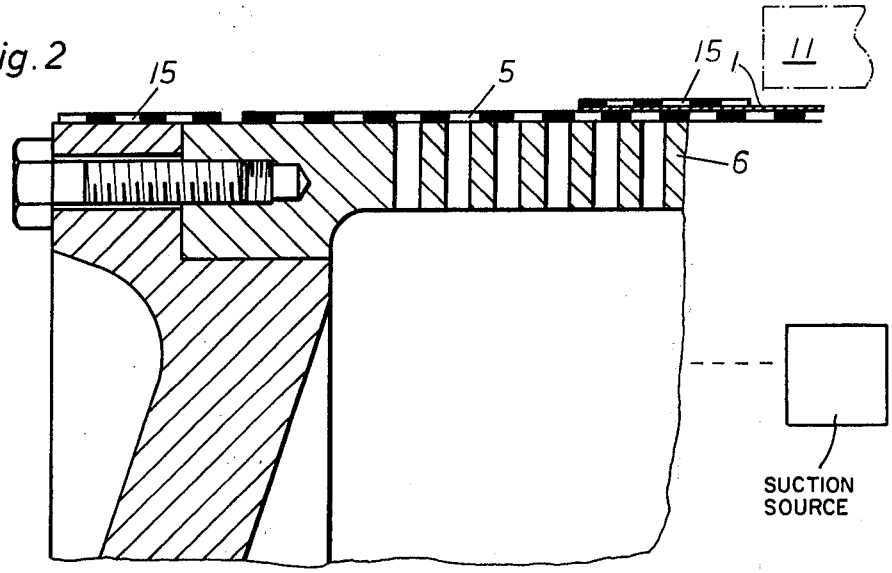
FIG. 2 is a fragmentary section through one of the suction cylinders of the arrangement in FIG. 1.

Once the leading end of the paper web 1 has been drawn into the drying arrangement, the guide band 15 is shifted laterally of the web 1 from the right-hand position shown in FIG. 2 to the left-hand position in which the band 15 rests on the marginal axial end portions of the rollers 6, 7 and 10 (only roller 6 is shown in FIG. 2 to show how its wall is perforate) so as not to interfere with the web 1. Of course, the band 15 might also be allowed to rest on the carrier band 5, that is the portion thereof which is not in supporting engagement with the web 1. The illustrated arrangement is, however, preferred. Assuming that for some reason one of the rollers, for instance the roller 10, does not have sufficient axial length so that the guide band 15 could rest on its marginal portion in the manner shown for the roller 6 in FIG. 2, then additional guide rollers 18 could be provided around which the guide band 15 could be trained so as not to travel around the roller 10; this is, of course, an alternative to the arrangement described above.

It will be understood that each of the elements described above, or two or more together, may also find a useful application in other types of constructions differing from the type described above.

While the invention has been illustrated and described as embodied in a machine for processing wettable webs, it is not intended to be limited to the details shown since various modifications and structural changes may be made without departing in any way from the spirit of the present invention.

Without further analysis, the foregoing will so fully reveal the gist of the present invention that others can by applying current knowledge readily adapt it for various applications without omitting features that from the standpoint of prior art fairly constitute essential characteristics of the generic or specific aspects of this invention.

What is claimed as new and desired to be protected by Letters Patent are set forth in the appended claims:

1. In a machine for processing moistenable webs, particularly in a paper-making machine, an arrangement for removing moisture from a moist web comprising, in combination, at least two hollow suction cylinders located in a first plane and each having a perforate circumferential wall which has an external and an internal surface; suction means at least partially accommodated within each hollow suction cylinder adjacent a portion of said inner surface thereof and operative for subjecting such portion to subatmospheric pressure; at least one contact-heater cylinder located in a second plane which is vertically spaced from said first plane and having a heated outer surface; means for supporting and guiding the web in a serpentine path extending, in succession, about one of said suction cylinders, said contact-heater cylinder and another suction cylinder, including a single endless traveling carrier band wider than said web and subject to damage when exposed to temperatures which are elevated to the optimum drying level for said web, said carrier band being interposed between said suction cylinders and the web so that moisture drawn by said suction means from the web passes through said carrier band on its way into the respective suction cylinder during travel of said carrier band about a portion of said external surface thereof, the web being interposed between said contact-heater cylinder and said carrier band so that moisture expelled by heating from the web also passes through said carrier band on its way outwardly away from said contact-heater cylinder during travel of said carrier band about a portion of said heated outer surface thereof, the web and said carrier band being exposed to ambient air at atmospheric pressure as they travel in portions of said serpentine path between said one suction cylinder and said contact-heater cylinder, and between said contact-heater cylinder and said other suction cylinder; and hot-air hoods associated with said suction cylinders and having a width less than the width of said web for directing against the same hot air at the optimum web drying temperature without damaging said carrier band.

2. In a machine as defined in claim 1; and further comprising a suction roller located adjacent said outer surface of said contact-heater cylinder in a region where the web and said carrier band become disengaged from the same, for exerting suction upon the web through said carrier band to prevent separation of the web from said carrier band and to enhance separation of the web from the contact-heater cylinder.

3. In a machine as defined in claim 2; and further comprising means for moving said suction roller towards and away from said outer surface of said contact-heater cylinder.

4. In a machine as defined in claim 2; and further comprising mounting means yieldably mounting said suction roller for displacement relative to said contact-heater cylinder.

5. In a machine as defined in claim 1, wherein the carrier band forms an endless loop and said moist web approaches said carrier band from the exterior of said loop; and further comprising a suction roller mounted within said loop inwardly adjacent to said carrier band for attracting the web against the same.

6. In a machine as defined in claim 1; further comprising a traveling guide band having a portion overlying a part of said carrier-band so that a leading end portion of the moist web may be inserted between and entrained by said part and portion; and further comprising means for shifting said guide band laterally away from said carrier band transverse to the direction of travel thereof.

* * * * *